US008931146B2

(12) United States Patent
Stanev

(10) Patent No.: US 8,931,146 B2
(45) Date of Patent: Jan. 13, 2015

(54) MULTIPLE MATERIAL TYING LACE

(75) Inventor: Christopher P. Stanev, Andover, MA (US)

(73) Assignee: Converse Inc., North Andover, MA (US)

( * ) Notice: Subject to any disclaimer, the term of this patent is extended or adjusted under 35 U.S.C. 154(b) by 330 days.

(21) Appl. No.: 13/313,800

(22) Filed: Dec. 7, 2011

(65) Prior Publication Data

US 2012/0144631 A1 Jun. 14, 2012

Related U.S. Application Data

(60) Provisional application No. 61/421,990, filed on Dec. 10, 2010.

(51) Int. Cl.
*A43C 1/02* (2006.01)
*A43C 1/00* (2006.01)
*A43C 9/00* (2006.01)

(52) U.S. Cl.
CPC .... *A43C 9/00* (2013.01); *A43C 1/02* (2013.01)
USPC ..... 24/715.3; 24/712

(58) Field of Classification Search
CPC ..... A43C 9/00; A43C 1/00; A43C 1/02; A43C 1/003
USPC ..... 24/712, 715.3
See application file for complete search history.

(56) References Cited

U.S. PATENT DOCUMENTS

| | | | | |
|---|---|---|---|---|
| 273,798 | A * | 3/1883 | Baldwin | 24/715.3 |
| 1,679,822 | A * | 8/1928 | Hall | 57/225 |
| 1,853,551 | A * | 4/1932 | Crimmins et al. | 57/225 |
| 1,989,066 | A | 1/1935 | Shaw | |
| 2,869,205 | A * | 1/1959 | Kacowski | 24/715.3 |
| 2,887,005 | A * | 5/1959 | Fromm | 87/1 |
| 3,059,518 | A * | 10/1962 | Nelson | 87/2 |
| 4,423,539 | A * | 1/1984 | Ivanhoe | 24/715.3 |
| 5,023,982 | A * | 6/1991 | Mehan | 24/715.3 |
| 5,287,601 | A * | 2/1994 | Schweitzer et al. | 24/715.3 |
| 6,283,004 | B1 * | 9/2001 | Tseng | 87/6 |
| 6,513,210 | B1 * | 2/2003 | Gonzalez | 24/712 |
| 6,681,459 | B1 * | 1/2004 | Curet et al. | 24/712 |
| 7,549,201 | B2 * | 6/2009 | Kraft et al. | 24/713 |
| 2006/0168785 | A1 * | 8/2006 | Kraft et al. | 24/715.3 |
| 2009/0144953 | A1 * | 6/2009 | Tsai | 24/712 |
| 2011/0047822 | A1 * | 3/2011 | Pape | 36/51 |
| 2012/0144631 | A1 * | 6/2012 | Stanev | 24/715.3 |
| 2013/0255045 | A1 * | 10/2013 | Gonzalez | 24/715.3 |

OTHER PUBLICATIONS

Notification of Transmittal of the International Search Report and the Written Opinion of the International Searching Authority, or the Declaration in PCT/US2011/064159 dated Apr. 4, 2012, 12 pages.

* cited by examiner

*Primary Examiner* — Robert J Sandy
(74) *Attorney, Agent, or Firm* — Shook, Hardy & Bacon L.L.P.

(57) ABSTRACT

Embodiments of the present invention relate to a tying lace constructed of an outer braided cover having a first thread type and a second thread type. The second thread type is formed from a different material and/or has a different cross-sectional area than the first thread type. In an exemplary embodiment, the cross-sectional area is at least twice that of the first thread type. Additionally, the second thread type may be of a material having higher elastic properties and/or a greater coefficient of friction than the first thread type. Further, in an exemplary embodiment, the tying lace is constructed with an elastic core extending the length of the tying lace.

18 Claims, 4 Drawing Sheets

MULTIPLE MATERIAL TYING LACE

CROSS-REFERENCE TO RELATED APPLICATIONS

This application claims benefit to U.S. Provisional Application No. 61/421,990, filed on Dec. 10, 2010, entitled "Multiple Material Tying Lace," which is incorporated in its entirety by reference herein.

BACKGROUND

Typically, a shoe or other article of footwear is secured about the foot of a wearer using a lacing structure. Commonly, a tying lace, such as a shoe string or lace, is used to bring together two portions of the footwear that allow the foot to enter the interior of the footwear. For example, in a traditional athletic shoe, a forefoot opening extends between a medial side and a lateral side of an upper portion of the shoe. A tying lace may extend across the forefoot opening, in this example, to bring the medial side and the lateral side of the upper together, which secures the shoe to the foot. However, the tying lace may loosen or completely untie as a result of the tying lace slipping through the knot intended to maintain tension in the tying lace.

Wearers (e.g., children) of shoes may have a difficult time tightening the tying lace sufficiently to prevent this slipping from occurring. However, adding an additional tying force may not prevent the tying lace from becoming loose or untied. Instead, as the knot of the tying lace loosens, a traditional lace may continue to untie because the traditional lace may not adapt in cross-sectional area to the force being applied nor may the traditional lace have an outer cover with a protrusion surface and a baseline surface that interact to resist slippage.

SUMMARY

Embodiments of the present invention relate to a tying lace constructed of an outer braided cover having a first thread type and a second thread type. The second thread type is formed from a different material and/or has a different cross-sectional area than the first thread type. The second thread type may have at least twice the cross-sectional area of the first thread type. Additionally, the second thread type may be of a material having higher elastic properties and a greater coefficient of friction than the first thread type. Further, in an exemplary embodiment, the tying lace is constructed with an elastic core extending the length of the tying lace.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
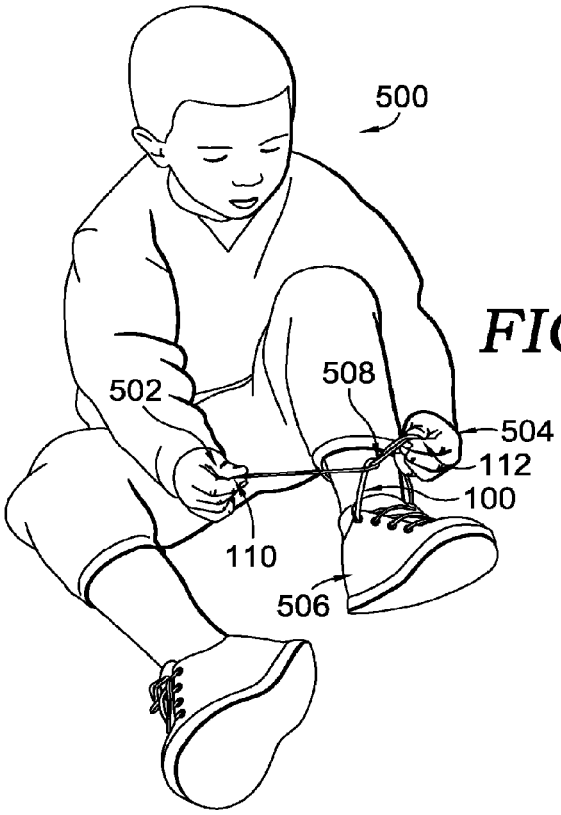
FIG. 1 depicts a wearer tying a shoe with a tying lace, in accordance with embodiments of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Embodiments of the present invention relate to a tying lace constructed of an outer braided cover having a first thread type and a second thread type. The second thread type is formed from a different material and/or has a different cross-sectional area than the first thread type. Additionally, the second thread type may be of a material having higher elastic properties and a greater coefficient of friction than the first thread type. Further, in an exemplary embodiment, the tying lace is constructed with an elastic core extending the length of the tying lace.

Accordingly, in one aspect, the present invention provides a tying lace having both a first end and a second end. An elastic center cord extends the length of the tying lace from the first end to the second end. The elastic center cord is encircled by a braided cover. The braided cover is constructed from a first group of threads of a first material, such as polyethylene, and each thread of the first group of threads has a first cross-sectional area. The braided cover is also constructed with a second group of threads that are made from a material different from the first material. The first group of threads and the second thread are interbraided such that the second thread forms a portion of the inner surface of the braided cover and a portion of the outer surface of the braided cover. Additionally, in this exemplary embodiment, each thread of the second group of threads has a cross-sectional area that is 200 to 900 percent greater than the first cross-sectional area.

A second aspect of the present invention provides another exemplary tying lace. The tying lace is constructed with a first plurality of threads having a first cross-sectional area. The tying lace is also constructed with a second plurality of threads having a second cross-sectional area that is at least twice the first cross-sectional area. The first plurality of threads and the second plurality of threads are interbraided to form a tubular cover having a longitudinal axis extending from the first end toward the second end. The tubular cover has an inner surface and an outer surface. A portion of the second plurality of threads protrude outwardly from the outer surface of the tubular cover a greater distance than the first plurality of threads protrude outwardly from the tubular cover.

A third aspect of the present invention provides another exemplary tying lace that is able to secure a shoe or other article to a foot of a wearer. The tying lace includes an outer cover that has an inner surface and an opposite outer surface. A first portion of the outer cover interacts with a second portion of the outer cover as the tying lace secures the shoe to the foot of the wearer. The outer cover is constructed from a first plurality of threads and a second plurality of threads interbraided together. At least 10 percent of the threads used to braid the outer cover are selected from the second plurality of threads. The first plurality of threads have a first cross-sectional area. The second plurality of threads have a second cross-sectional area that is between twice the cross-sectional area of the first cross-sectional area and sixteen times the cross-sectional area of the first cross-sectional area. The second plurality of threads are made from a material that is different from the first material and the second material has a greater coefficient of friction than the first material when interacting with the first material. Additionally, the second plurality of threads protrude a greater distance from the outer surface of the outer cover than the first plurality of threads protrude. The tying lace also includes an elastic core that extends the length of the outer cover near the inner surface. Further yet, the tying lace includes an aglet at each end. The aglets encircle the outer cover near the first end and the second end.

Having briefly described an overview of embodiments of the present invention, a more detailed description follows.

The construction of an exemplary tying lace 100 includes a tubular outer cover 300 formed from braided threads. The braided threads that form the outer cover 300 may include a first plurality of threads 302 and a second plurality of threads 304. The first plurality of threads 302 may be any material, but in an exemplary embodiment, the first plurality of threads 302 are formed from a material traditionally utilized to form an outer cover of a tying lace. For example, polyethylene, nylon, or a natural fiber may be used. To the contrary, the second plurality of threads 304 are a different material than the first plurality of threads 302. For example, the second plurality of threads 304 may be an elastomer, such as a polyurethane-polyurea copolymer. The outer cover 300 may encircle (e.g., surround) a core 200. The core 200 may be any material, but in an exemplary embodiment, the core 200 is a material possessing elastic characteristics.

The tying lace 100 is a lace that resists untying that may be experienced by a typical lace. For example a tying lace, such as the tying lace 100, may be used to secure an article of footwear 506 (e.g., shoe, boot, and the like) about a foot of a wearer 500 (as depicted in FIG. 1). However, a lace used to secure an article of footwear may untie during use of the article of footwear by the wearer 500. The tying lace 100 provides several functional features that will be discussed in greater detail hereinafter. But, an exemplary feature of the tying lace 100 includes utilization of the second plurality of threads 304, which may have a variable cross-sectional area based on a tension force being applied. The variable cross-sectional area of the second plurality of threads 304 allows for a knot to be tied utilizing the tying lace 100, upon a reduction in tension to the tying lace (i.e., completion of the knot tying process), a portion of the second plurality of threads 304 may expand in cross-sectional area further tightening the knot and/or inhibiting a portion of the tying lace 100 from being "pulled" through the knot causing the knot to loosen. Similarly, the core 200 may also have a variable cross-sectional area that is a function of tension applied along a longitudinal axis 310 of the tying lace 100. Upon reduction in the tension force, the core 200 may increase in cross-sectional area proximate the knot (and/or distal to the knot). The core 200 may also incorporate a variable cross-sectional material causing a core cross-sectional area 260 to also be variable.

Another functional feature realized by the tying lace 100 relates to an interaction of the second plurality of threads 304 proximate a knot. For example, the second plurality of threads 304 may have a cross-sectional area that is greater than the first plurality of threads 302. This difference in cross-sectional area may result in peaks and valleys forming on an outer surface 306 of the outer cover 300. When the outer cover 300 interacts with itself (e.g., at a knot), the peaks and valleys of the two portions of the outer cover 300 may resist untying of a knot. Additionally, it is contemplated that the second plurality of threads 304 is formed from a material having a higher coefficient of friction when interacting with itself than the first plurality of threads 302 has when interacting with itself. Therefore, the increased coefficient of friction and the peaks/valleys texture, either individually or in combination, may encourage resisting an untying action of the tying lace 100.

FIG. 1 depicts the wearer 500 tying a knot with the tying lace 100. As used herein, the term "tying lace" refers to any cord, string, lace, and the like that is functional for securing to itself. For example, a tying lace may interact with itself (e.g., a shoe lace knot) to maintain a level of tension within the tying lace (e.g., a level of tension in a portion of a shoe string traversing a shoe forefoot opening). Therefore, while the terms "tying" and "lace" are used herein, it is understood that those terms include similar concepts as can be drawn from the present discussion and figures. In particular, it is contemplated that the term tying lace includes shoe strings (shoe-strings), laces, and other lacing structures that may be utilized with articles of clothing/footwear.

In an exemplary embodiment depicted in FIG. 1, the wearer 500 is grasping a first end 110 of the tying lace 100 with his right hand 502. Similarly, the wearer 500 is grasping a second end 112 of the tying lace 100 with his left hand 504, as is typical with a process of tying a shoe lace. The wearer 500 is performing a known technique of causing the tying lace 100 to interact with itself to form a knot to secure the shoe 506 about (to) the foot of the wearer 500. However, because the tying lace is comprised of several functional features discussed herein, a point of interaction 508 where a first portion of the tying lace 100 interacts with a second portion of the tying lace 100 resists unintentional slipping of the first portion from the second portion, which could cause the knot to loosen.

Figure 2:
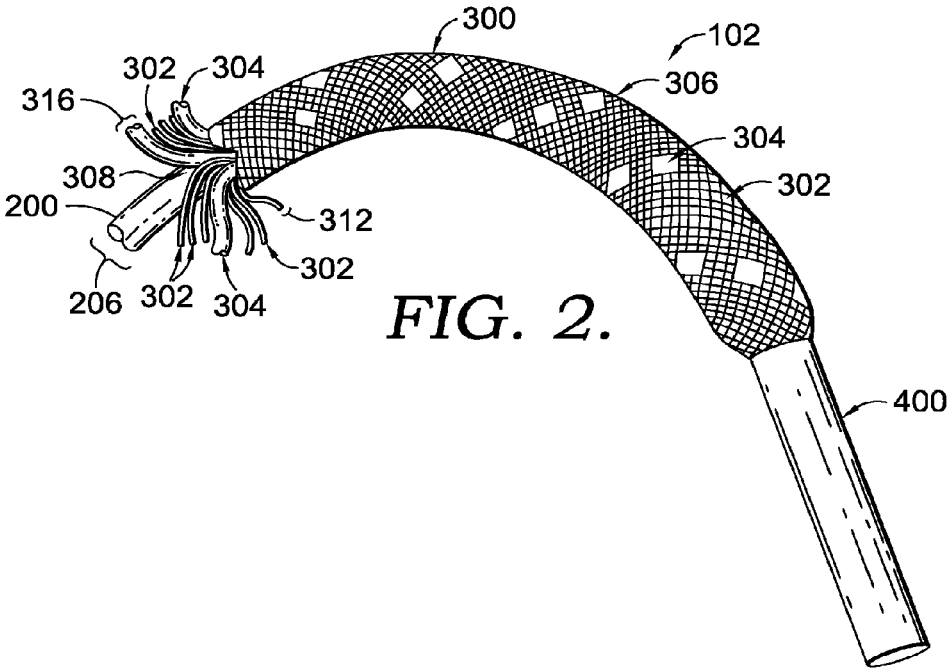
FIG. 2 depicts a first exemplary tying lace having a plurality of thicker cross-sectional area threads incorporated in the outer cover, in accordance with an embodiment of the present invention.

FIG. 2 depicts an exemplary embodiment of a tying lace 102, in accordance with aspects of the present invention. The tying lace 102 is constructed having the cord 200 forming a central portion of the tying lace 102. The cord 200 may be a unitary thread or a plurality of threads, strands, or cords. For illustration purposes, a single filament is depicted, but it is contemplated that a plurality of filaments may be utilized in conjunction to form the cord 200. For example, several threads may be braided, woven, twisted, or merely parallel to one another to form the cord 200.

The cord 200, in an exemplary embodiment, is an elastic material. An elastic material possess a physical property of elasticity, which allows a material to return to a substantially original form, shape, length, etc. after a force is applied (e.g., deformation force, tensile force, compressive force, and the like). For example, a rubber band possess a physical property of elasticity, which allows the rubber band to apply a tension force to an object surrounded by the rubber band as the rubber band attempts to return to its substantially original shape, size, or form.

A variety of materials are contemplated as being suitable for constructing the cord 200. For example, a synthetic rubber, a natural rubber, a polyurethane-polyurea copolymer, and the like are elastic-type materials. The polyurethane-polyurea copolymer material is sometimes referred to as SPANDEX, LYCRA, or ELASTANE. Additionally, it is contemplated that the cord 200 may be constructed of a synthetic or natural fiber typically utilized in forming a shoelace. For example, cotton, nylon, polyethylene, and the like may also form at least a portion of the cord 200. It is also contemplated that the tying lace 102 may be formed without a cord 200. Instead, the outer cover 300 may remain a "hollow" structure not encircling the cord 200.

In an exemplary embodiment, the outer cover 300 is braided around the cord 200 to form the tying lace 102. As will be discussed in more detail hereinafter, tension applied to the cord 200 during the braiding process imparts characteristics to the tying lace 102 upon completion. For example, if the cord 200 is "pulled" (tensioned) too much while having the outer cover 300 braided around the cord 200, and the cord 200 has elastic properties, then the cord 200 may contract (return to an original size) within the interior of the outer cover 300. In the alternative, if the outer cover 300 is affixed to a portion of the cord 200 prior to reducing the tension of the cord 200, the outer cover 300 may have a longer length than the resulting tying lace 102 causing the outer cover 300 to bunch around the cord 200. It is contemplated that both results may be intended with aspects of the present invention to achieve advantages of the present invention. Similarly, if the cord 200 is not provided enough tension during the outer cover braiding process, the core 200 may have a longer length than the resulting tying lace 102 causing the core 200 to bunch within the interior volume of the outer cover 300.

Figure 5:
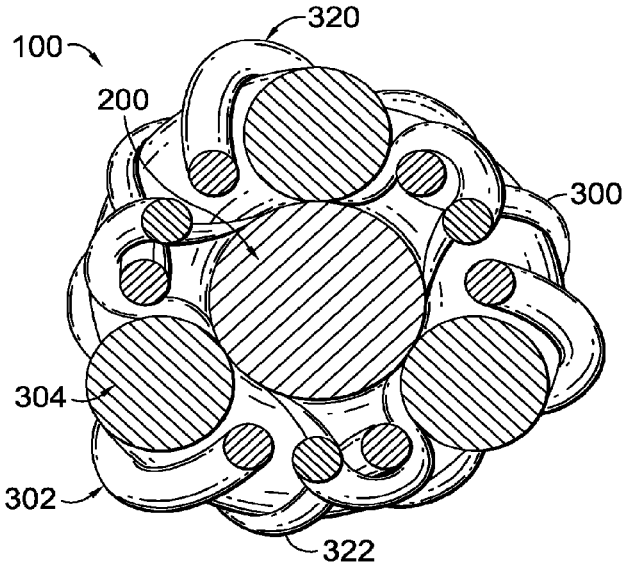
FIG. 5 depicts a cross sectional view taken along line 5-5 of FIG. 3 of an exemplary tying lace having a core, a first thread type, and a larger second thread type, such that a cross-sectional area of the core, the first thread type, and the second thread type is depicted, in accordance with an embodiment of the present invention.
Figure 6:
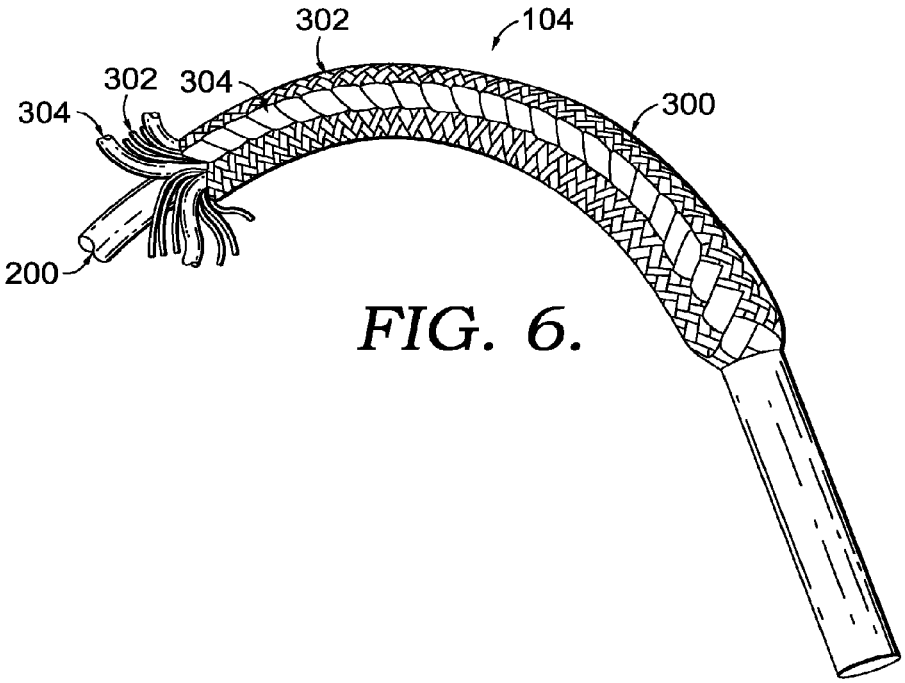
FIG. 6 depicts a second exemplary tying lace having a second braid formation, in accordance with an embodiment of the present invention.

The outer cover 300, as discussed above, is a braided structure that forms an outer surface of the tying lace 102. However, as the outer cover 300 is a tubular structure in an exemplary embodiment, the outer cover 300 has an inner surface 308 and an outer surface 306. The inner surface 308 defines an internal volume of the outer cover 300, such that the internal volume may be occupied, at least in part, by the cord 200. The outer surface 306 may be comprised of two primary portions, a baseline outer surface 320 and a protrusion outer surface 322 (as best seen in FIG. 5). The baseline outer surface 320 is an outer surface that typically exists with a traditional tying lace constructed from threads having a cross-sectional area with deviation less than 100 percent of one another (e.g., not one thread is larger than twice the cross-sectional area of another thread used to construct the tying lace outer cover). The baseline outer surface provides a substantially consistent outer surface that may not be ideal for maintaining a knot.

Figure 3:
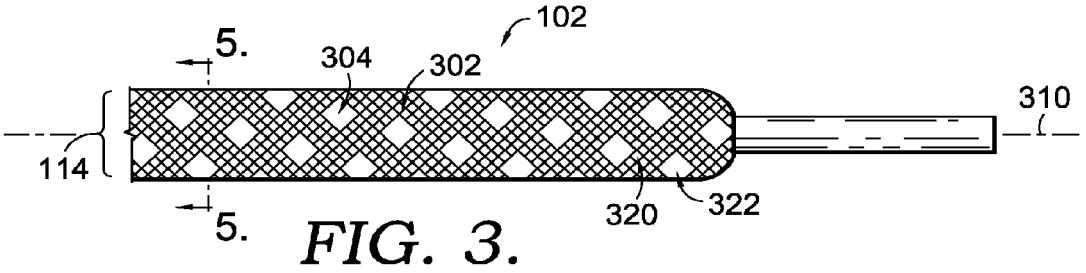
FIG. 3 depicts the first exemplary tying lace in an at-rest state, in accordance with an embodiment of the present invention.
Figure 4:
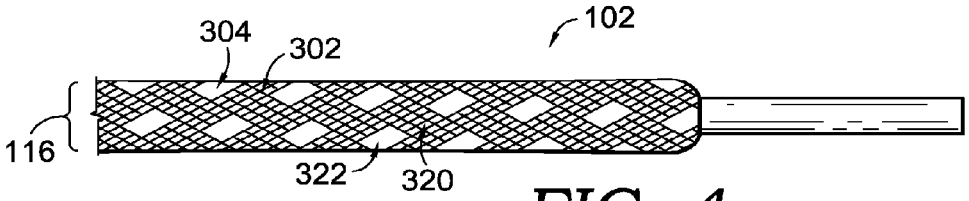
FIG. 4 depicts the first exemplary tying lace in a tensioned state, in accordance with an embodiment of the present invention.

Conversely, the protrusion outer surface 322 is formed from the second plurality of threads 304 extending beyond the baseline outer surface 320 as one or more of the second plurality of threads 304 forms an exterior most portion of the outer cover 300. For example, as depicted at FIGS. 3 and 4, the first plurality of threads 302 are braided with the second plurality of threads 304 to form the outer cover 300. However, where one of the second plurality of threads 304 forms the exterior most portion of the outer cover, the protrusion outer surface 322 is formed.

In an exemplary embodiment, the protrusion outer surface 322 results from the second plurality of threads 304 having a cross-sectional area that is greater than the first plurality of threads 302. Consequently, when threads of differing cross-sectional areas are braided together to form a braided outer cover, the larger cross-sectional area thread affects the braid and resulting texture of the braided outer cover. Traditionally, variability to the braid and the resulting texture may be undesired and actually prevented. However, aspects of the present invention may desire to introduce a textured effect (different in outwardly extension from the outer cover 300 of the base line outer surface 320 and the protrusion outer surface 322).

In an exemplary embodiment, a thread from the second plurality of threads 304 has a cross-sectional area that is at least 200 percent (twice the cross-sectional area) of a thread from the first plurality of threads 302. Having a size differential less than 200 percent may not accomplish aspects of the present invention. In an additional exemplary embodiment, a thread of the second plurality of threads 304 has a cross-sectional area that is between (and including) 200 percent and 900 percent a cross-sectional area of a thread from the first plurality of threads 302. In yet an additional exemplary embodiment, the cross-sectional area of the second plurality of threads 304 may be two to sixteen times the cross-sectional area of the first plurality of threads 302. For example, FIG. 2 depicts a cross-sectional area 312 of one of the plurality of first threads 302 that is less than a cross-sectional area 316 of one of the second plurality of threads 304.

The cross-sectional area of an elastic thread used as part of the tying lace 100 may change when tension is applied compared to when the thread is at rest. Consequently, a thread having a variable cross-sectional area that changes with a load applied may be utilized in aspects of the present invention. For example, the second plurality of threads 304 may be constructed from an elastic material that also has a variable cross-sectional area. When a knot is tied with the tying lace 100 having a variable cross-sectional area thread, the cross-sectional area of the thread may be reduced when a tying force is applied, but once the tying force (e.g., the right hand 502 and the left hand 504 pulling on the tying lace 100) is removed after the knot is tied, the cross-sectional area of the thread may try and expand to an original cross-sectional area. The expansion of the thread's cross-sectional area further tightens the knot beyond that which was accomplished by the tying force previously applied. Further yet, the expansion of the thread's cross-sectional area applies a force in an outwardly direction that may not be typically supplied by a tying force aligned with a longitudinal axis 310 (as depicted in FIG. 3). The core 200 and/or at least one of the second plurality of threads 304 may be constructed from a material having a force-varied cross-sectional area.

Construction of the outer cover 300 includes interbraiding the first plurality of threads 302 and the second plurality of threads 304. The general concept of braiding is well known in the art and not discussed herein. However, the utilization of the second plurality of threads 304 having characteristics discussed herein (e.g., variable cross-sectional area, larger cross-sectional area than the first plurality of threads 302, elastic properties, and the like) is novel to embodiments of the present invention. Typically a number of threads are braided together to form a tubular structure. The number of threads braided together may be manipulated to change a size of the resulting tubular structure. Additionally, the size of the threads may also be adjusted to change the resulting tubular structure. Regardless, the general concept of braiding involves alternating an orientation of intersecting threads relative to the resulting tubular structure (inner surface v. outer surface) as the threads counter rotate relative to one another. For example, a first thread rotates clockwise around the longitudinal axis of the tying lace and a second thread rotates counter-clockwise around the longitudinal axis of the tying lace. As a result, the first thread may be on an outer surface of the resulting tubular structure (e.g. outer cover) relative to the second strand, but the first thread may be positioned at the inner surface of the tubular structure relative to a subsequent counter-clockwise rotating thread.

The counter-clockwise ("CCW") rotating threads and the clockwise ("CW") rotating threads that rotate about the longitudinal axis 310 will be discussed in more detail hereinafter. The CCW threads may include one or more of the first plurality of threads 302 and one or more of the second plurality of threads 304. Alternatively, the CCW threads may include only threads from the first plurality of threads 302 or threads from the second plurality of threads 304. Similarly, the CW threads may be comprised of one or more threads from the first plurality of threads 302 and one or more threads from the second plurality of threads 304. Additionally, it is contemplated that the CW threads may include threads only from the first plurality of threads 302 or the second plurality of threads 304. In an exemplary embodiment, the CW threads include only threads from the first plurality of threads 302 and the CCW threads include a combination of threads from both the first plurality of threads 302 and the second plurality of threads 304. In this example, it is understood that CW and CCW may be substituted for one another as the actual direction of rotation may not affect an exemplary embodiment.

When threads from both the first plurality of threads 302 and threads from the second plurality of threads 304 are used in combination for the CCW threads (or the CW threads), it is contemplated that two or more of the second plurality of threads 304 are arranged in a series. Alternatively, it is contemplated that at least one thread from the first plurality of threads 302 prevents two consecutive threads in a series from the second plurality of threads 304.

In an exemplary embodiment, it is contemplated that the second plurality of threads 304 are braided in both a CCW and CW direction. As a result of the multiple directional braid, a thread of the second plurality of threads 304 overlaps with another thread of the second plurality of threads 304, which forms a greater protrusion distance from the outer surface than if a thread of the second plurality of threads 304 only overlaps a smaller thread from the first plurality of threads 302. Consequently, it is contemplated that braiding threads from the second plurality of threads in both a CW and CCW direction results in at least three outer surface portions, the baseline outer surface, the protrusion outer surface, and a greater outer protrusion surface resulting from the overlap of threads from the second plurality of threads 304.

Embodiments of the present invention contemplate utilizing 10 to 15 threads from the second plurality of threads 304, while the remaining threads (e.g., 52) utilized to construct the outer cover 300 are selected from the first plurality of threads 302. Additionally, it is contemplated that a composition of the outer cover 300 includes 14 percent to 24 percent threads from the second plurality of threads 304, the additionally 76 percent to 86 percent of the threads forming the outer cover 300 may include threads from the first plurality of threads 302. A concentration of threads from the second plurality of threads 304 in a range from (and including) 14 to 24 percent provides a desired level of resistance of untying of the tying lace 100, in an exemplary embodiment. A concentration that is greater than 24 percent may provide too much resistance to untying and a concentration less than 14 percent may not supply enough resistance to untying to the tying lace 100, in an exemplary embodiment. However, it is contemplated that concentration greater than and less than those discussed herein are within the scope of the present invention.

The concentration of threads from the second plurality of threads 304 may relate to a cross-sectional area (or a relational cross-sectional area compared to the first plurality of threads 302). For example, a lower concentration of the second plurality of threads 304 may be utilized as the cross-sectional area of a thread from the second plurality of threads 304 increases. Additionally, the concentration of threads from the second plurality of threads 304 when constructing the outer cover 300 may depend on an intended application or intended wearer. For example, a shoe that typically does not experience much lateral force exerted by the wearer (which may be responsible for causing the loosening of a knot) may not have as high of a concentration of the second plurality of threads. In the alternative, an athletic shoe that will experience significant forces exerted by a wearer may desire to have a higher concentration of the second plurality of threads 304, in an exemplary embodiment.

In an exemplary embodiment, the outer covering 300 is formed by integrally braiding threads from the first plurality of threads 302 and threads from the second plurality of threads 304. In particular, at least 10 percent of the threads braided to form the outer covering 300 are selected from the second plurality of threads 304. It is contemplated that a concentration of the second plurality of threads 304 that is less than 10 percent of the total quantity of threads may not provide functionality (e.g., resistance to slippage) discussed herein, in an exemplary embodiment.

In an additional exemplary embodiment, the second plurality of threads 304 also forms a portion of the inner surface 308 of the outer covering 300. Advantages discussed herein with respect to the outer surface may be realized with the interaction of the second plurality of threads 304 and the core 200. For example, in an exemplary embodiment, the core 200 is formed from an elastic material that is stretchable in a longitudinal direction. Interaction of the second plurality of threads 304 and the core 200 during the stretching of the core 200, allows the outer cover, which integrally includes the second plurality of threads 304, to maintain registration with each other (e.g., in a common alignment) during the stretching process. This interaction may result from an increased coefficient of friction between the second plurality of threads 304 and the core 200 as compared to a coefficient of friction between the first plurality of threads 302 and the core 200.

FIG. 3 depicts the tying lace 102 in an at-rest state. An at-rest state is when a force is not actively being applied to the tying lace 100 in a direction parallel to the longitudinal axis 310. Stated differently, a wearer is not actively applying a tying force when the tying lace 102 is in an at-rest state. When in an at-rest state, the tying lace 102 has a cross-sectional area 114. FIG. 4 depicts the tying lace 102 in a tensioned state. A tensioned state is a state where the tying lace 102 is experiencing an actively applied tension force parallel to the longitudinal axis 310. When in a tensioning state, the tying lace 102 has a cross-sectional area of 116, which is less than the cross-sectional area 114 of the at-rest state.

Figure 7:
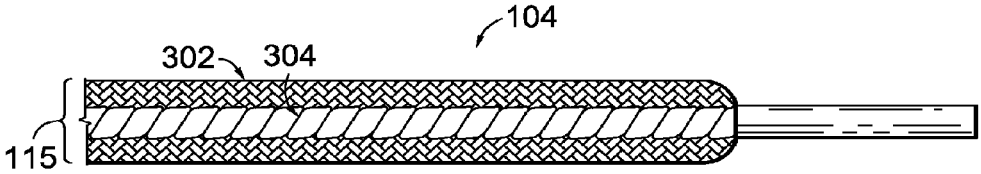
FIG. 7 depicts the second exemplary tying lace in an at-rest state, in accordance with an embodiment of the present invention.
Figure 8:
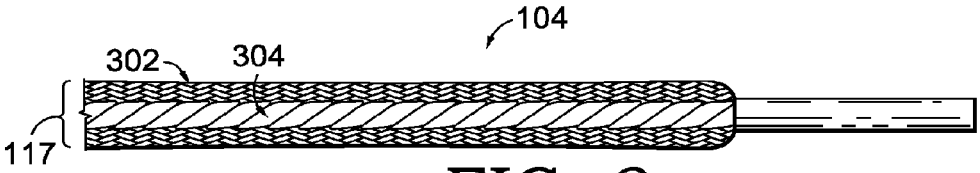
FIG. 8 depicts the second exemplary tying lace in a tensioned state, in accordance with an embodiment of the present invention.
Figure 9:
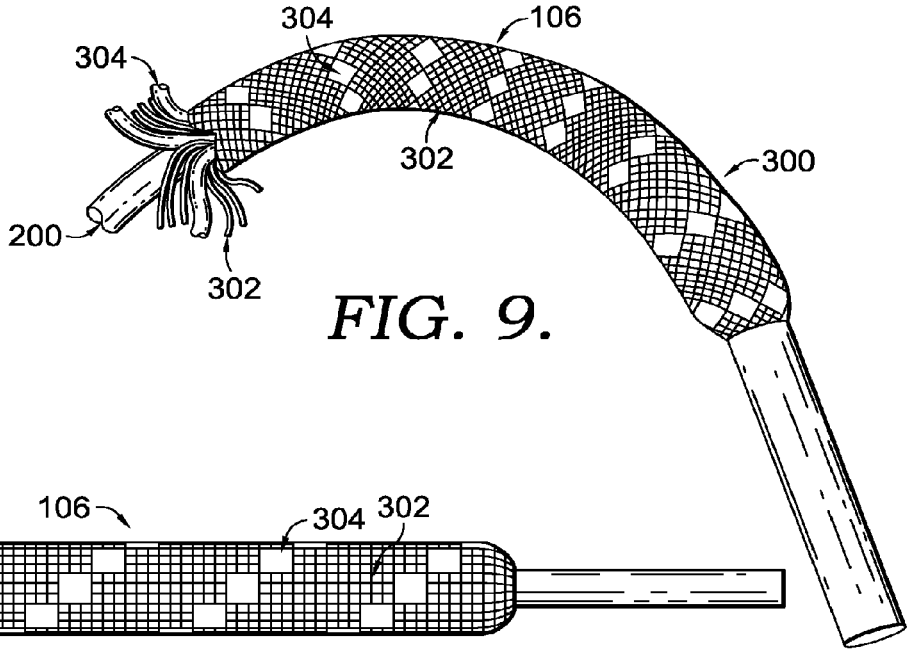
FIG. 9 depicts a third exemplary tying lace having a third braid formation, in accordance with an embodiment of the present invention.

Similarly, FIG. 7 depicts another exemplary tying lace 100, a tying lace 104. The tying lace 104 is in an at-rest state in FIG. 7, which results in the tying lace 104 having a cross-sectional area 115. FIG. 8 depicts the tying lace 104 in a tensioned state. The tensioned state of the tying lace 104 has a cross-sectional area 117, which is less than the cross-sectional area 115 of the tying lace 104 in the at-rest state.

Figure 10:
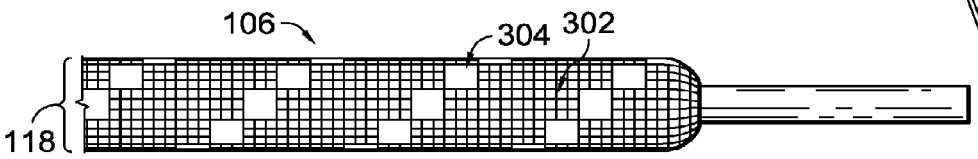
FIG. 10 depicts the third exemplary tying lace in an at-rest state, in accordance with an embodiment of the present invention.
Figure 11:
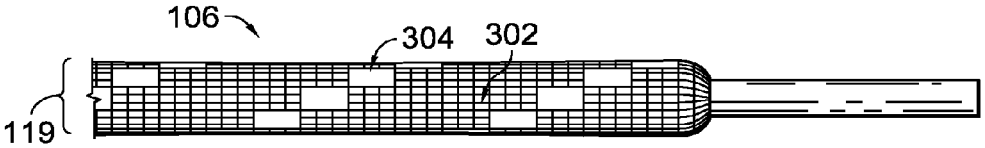
FIG. 11 depicts the third exemplary tying lace in a tensioned state, in accordance with an embodiment of the present invention.

FIG. 10 depicts another exemplary tying lace 100, a tying lace 106. The tying lace 106 is in an at-rest state in FIG. 10, which results in the tying lace 106 having a cross-sectional area 118. FIG. 11 depicts the tying lace 106 in a tensioned state. The tensioned state of the tying lace 106 has a cross-sectional area 119, which is less than the cross-sectional area 118 of the tying lace 106 in the at-rest state.

Figure 12:
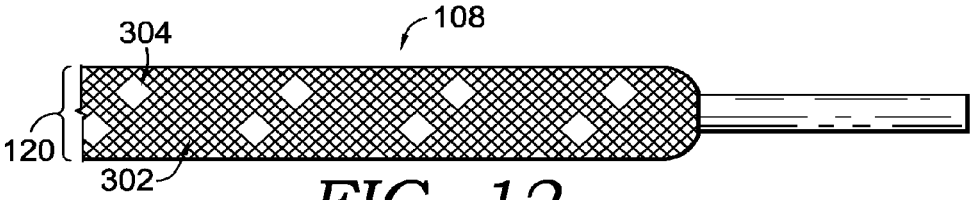
FIG. 12 depicts a fourth exemplary tying lace in an at-rest state, in accordance with an embodiment of the present invention.
Figure 13:
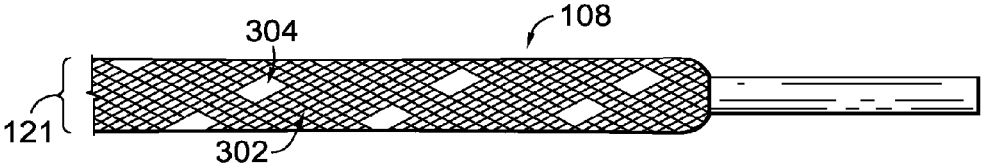
FIG. 13 depicts the fourth exemplary tying lace in a tensioned state, in accordance with an embodiment of the present invention.

FIG. 12 depicts another exemplary tying lace 100, a tying lace 108. The tying lace 108 is in an at-rest state in FIG. 12, which results in the tying lace 108 having a cross-sectional area 120. FIG. 13 depicts the tying lace 108 in a tensioned state. The tensioned state of the tying lace 108 has a cross-sectional area 121, which is less than the cross-sectional area 120 of the tying lace 108 in the at-rest state.

The tying laces 102, 104, 106, and 108 are exemplary tying laces that may utilize different braiding techniques, different concentrations of threads, different thread cross-sectional areas, and different material, in accordance with aspects of the present invention.

As depicted in the various figures, the protrusion outer surface 322 may change in shape and/or size based on if the tying lace is in an at-rest or tensioned state. In an exemplary embodiment, the protrusion outer surface 322 elongates and reduces a protrusion distance from the underlying baseline outer surface 320 when in a tensioned state as compared to when in an at-rest state. This reduction in protrusion distance may allow the tying lace to more easily tie and interact with itself than when in an at-rest state.

As previously discussed, the second plurality of threads 304 may be a different material than the first plurality of threads. For example, the second plurality of threads may be a material having elastic properties, such as a polyurethane-polyurea copolymer. In an exemplary embodiment, a 10 Nm or a 15 Nm polyurethane-polyurea copolymer is utilized as the second material. Stated differently, it is contemplated that a 600 denier and a 900 denier elastic material is used as the second material. The first plurality of threads 302 may be a material such as polyethylene, nylon, or other natural materials (e.g., cotton, hemp, jute, and the like). For example, it is contemplated that a 300 denier bulked polyethylene yarn is used as a material of the first plurality of threads 302.

In an exemplary embodiment, it is contemplated that the first material and the second material have a substantially similar material density to one another. In this example, a size relationship may then be determined based on a listed denier of the first material and of the second material. Therefore, a first material with a 300 denier and a second material with a 600 denier may have twice the cross-sectional area. A similar material density may be advantageous in embodiments of the present invention for manufacturing the tying lace 100. For example, in a braiding process that incorporates CW and CCW rotation of threads to be braided, a material having a substantially different material density may be affected in a greater amount than a material having a lower material density during braiding. The difference in material density may cause the higher material density material to work its way toward the outside surface of the braided cover from additional centrifugal force. However, it is also contemplated that is desired in an exemplary embodiment to capitalize on the greater centrifugal effect on the denser material to increase the concentration of denser material to the outer surface of a braided cover.

In an exemplary embodiment, the material used as part of the second plurality of threads 304 has a greater coefficient of friction as it interacts with itself (e.g., at the point of interaction 508 of FIG. 1) than the material from which the threads of the first plurality of threads 302 are formed. This differential in coefficient of friction may further aid in resisting a loosening of a knot while still allowing the tying lace 100 to be tied.

As is typical of a shoestring, an aglet may be incorporated. An aglet is traditionally utilized to terminate a tying lace and to aid in threading the lace through one or more apertures of a shoe. Embodiments of the present invention also rely on an aglet 400 to maintain the second plurality of threads 304 in a position relative to the first plurality of threads 302. For example, if the second plurality of threads 304 are an elastic material and the first plurality of threads 302 are a typical polyethylene material, the second plurality of threads may stretch when a tying force is applied, but the first plurality of threads 302 may resist elongation causing one of the threads to try and separate from the other threads. An aglet positioned at both ends of the tying lace may maintain an intended relationship between the first plurality of threads 302 and the second plurality of threads 304 during a tensioning/at-rest cycle experienced by the tying lace 100.

As used herein, the term "thread" is not limiting to a particular textile material or structure (e.g., thread, yarn, fiber, string, cord, and the like), but generally refers to a flexible material useable for constructing the tying lace 100. For example, a thread may be a synthetic material, a natural material, or a combination. Additionally, a thread may be composed of a plurality of filaments, which may be spun, twisted, braided, woven, or otherwise grouped and/or bound together.

Additionally, the term "cross-sectional area" is used herein to discuss a cross-sectional surface area of one or more components (e.g., thread, tying lace). A cross-sectional area of a generally round may be estimated with an area equation for a disk (circle). For example, a cross-sectional area of a thread may be approximated based on $(\pi(D^2))/4$, where D is equal to the diameter of the thread. Therefore, it is contemplated that when a first material having a similar material density (mass per volume) of a second material is compared, a cross sectional area may be approximated from the difference in a linear mass (denier) of the threads. For example, a first material having a 300 denier and a similar volume mass with a second material having a 600 denier, it can be approximated that the cross-sectional area of the second material is about twice that of the first material.

The invention claimed is:

1. A tying lace having a first end and a second end, comprising:

an elastic center cord extending from the first end to the second end; and a braided cover encircling the elastic center cord, the braided cover extending from the first end to the second end, wherein the braided cover is comprised of:

(1) a first plurality of threads of a first material, wherein each of the first plurality of threads has a first cross-sectional area, and (2) a second plurality of threads of a second material having elastic properties, the second material being of a different material than the first material, the second plurality of threads of the second material having a second cross-sectional area of at least 200 percent greater than the first cross-sectional area, wherein the first plurality of threads and the second plurality of threads are interbraided such that the second plurality of threads forms a portion of an inner surface of the braided cover and forms a portion of an outer surface of the braided cover, wherein 14-24 percent of threads forming the braided cover are selected from the second plurality of threads to provide the desired level of resistance of untying to the tying lace.

2. The tying lace of claim 1, wherein the elastic center cord is comprised of a third plurality of threads.

3. The tying lace of claim 1, wherein the elastic center cord is constructed from the second material.

4. The tying lace of claim 1, wherein the elastic center cord is constructed from a polyurethane-polyurea copolymer.

5. The tying lace of claim 1, wherein the braided cover is constructed from 10 to 15 discrete threads of the second material.

6. The tying lace of claim 1, wherein the first material is a polyethylene.

7. The tying lace of claim 1, wherein the first material is a natural fiber or a polymer-based fiber.

8. The tying lace of claim 1, wherein the second material is a polyurethane-polyurea copolymer.

9. The tying lace of claim 1, wherein a first thread of the second plurality of threads is braided in a first rotational direction and a second thread of the second plurality of threads is braided in a second rotational direction.

10. The tying lace of claim 1, wherein the second cross-sectional area of the second material reduces a greater percentage than the first cross-sectional area of the first material when a tensile force is applied to the tying lace.

11. The tying lace of claim 1, wherein a cross-sectional area of the tying lace reduces when a tensile force is applied along a length extending from the first end toward the second end.

12. A tying lace comprising:

a first plurality of threads having a first cross-sectional area; and a second plurality of threads having a second cross-sectional area, the second cross-sectional area being at least twice the first cross-sectional area, wherein the first plurality of threads and the second plurality of threads are interbraided forming a tubular cover having a longitudinal axis extending from a first end to a second end, the tubular cover having an inner surface and an outer surface, such that a portion of the second plurality of threads protrudes outwardly from the outer surface a greater distance than the first plurality of threads, wherein the tubular cover is constructed such that 14-24 percent of braided threads forming the tubular cover are selected from the second plurality of threads.

13. The tying lace of claim 12, wherein the first plurality of threads is a first material and the second plurality of threads is a second material, the first material being different from the second material.

14. The tying lace of claim 13, wherein the second material is an elastic material.

15. The tying lace of claim 14, wherein the second material is a polyurethane-polyurea copolymer.

16. The tying lace of claim 12 further comprising an elastic core proximate the inner surface of the tubular cover.

17. The tying lace of claim 16, wherein a material of the elastic core and the second material are a similar material.

18. A tying lace able to secure an article of footwear about a foot, comprising:

an outer cover having an inner surface and an opposite outer surface, a first portion of the outer surface interacting with a second portion of the outer surface as the tying lace secures the article of footwear about the foot, the outer cover being comprised of a first plurality of threads interbraided with a second plurality of threads, such that 14-24 percent of the outer covering is constructed from the second plurality of threads, wherein:

(3) the first plurality of threads has a first cross-sectional area, wherein the first plurality of threads is a first material selected from: polyethylene, nylon, or cotton, and (4) the second plurality of threads has a second cross-sectional area in an at-rest state, the second cross-sectional area being between about twice the first cross-sectional area and about sixteen times the first cross-sectional area, wherein the second plurality of threads is a second material selected from: a polyurethane-polyurea copolymer, a synthetic rubber, or a natural rubber, such that the second material interacting with the second material has a greater coefficient of friction than the first material interacting with the first material, wherein the second plurality of threads protrudes a greater distance from the outer surface of the outer cover than the first plurality of threads;

an elastic core extending a length of the tying lace proximate the inner surface of the outer cover, the elastic core being of a material selected from: a polyurethane-polyurea copolymer, a synthetic rubber, or a natural rubber; and a first aglet and a second aglet, wherein the first aglet is encircles the outer cover proximate a first end of the outer cover and the second aglet encircles the outer cover proximate a second end of the outer cover.

* * * * *